US006047552A

United States Patent [19]

Gross et al.

[11] Patent Number: 6,047,552

[45] Date of Patent: Apr. 11, 2000

[54] HEAT-SHIELD COMPONENT WITH COOLING-FLUID RETURN AND HEAT-SHIELD CONFIGURATION FOR A COMPONENT DIRECTING HOT GAS

[75] Inventors: Heinz-Jürgen Gross, Meulheim A.D. Ruhr; Wilhelm Schulten, Duisburg, both of Germany

[73] Assignee: Siemens Aktiengesellschaft, Munich, Germany

[21] Appl. No.: 09/277,279

[22] Filed: Mar. 26, 1999

Related U.S. Application Data

[63] Continuation of application No. PCT/DE97/02168, Sep. 24, 1997.

[30] Foreign Application Priority Data

Sep. 26, 1996 [DE] Germany ..... 196 39 630
Sep. 26, 1996 [DE] Germany ..... 196 39 694

[51] Int. Cl.[7] ..... F02G 1/00

[52] U.S. Cl. ..... 60/752; 60/760; 165/908

[58] Field of Search ..... 60/752, 760; 165/908, 165/80.2, 696, 169

[56] References Cited

U.S. PATENT DOCUMENTS

| | | | |
|---|---|---|---|
| 4,749,029 | 6/1988 | Becker et al. . | |
| 4,820,097 | 4/1989 | Maeda et al. . | |
| 5,216,886 | 6/1993 | Ewing . | |
| 5,390,076 | 2/1995 | Umezawa | 361/689 |
| 5,782,294 | 7/1998 | Froemming et al. | 165/168 |
| 5,799,491 | 9/1998 | Bell et al. | 60/752 |

FOREIGN PATENT DOCUMENTS

| | | |
|---|---|---|
| 0 224 817 B1 | 6/1987 | European Pat. Off. . |
| 0 225 527 A2 | 6/1987 | European Pat. Off. . |
| 0 597 137 A1 | 5/1994 | European Pat. Off. . |
| 0 624 757 A1 | 11/1994 | European Pat. Off. . |
| 20 29 918 | 12/1970 | Germany . |
| 42 44 302 A1 | 6/1994 | Germany . |
| 849255 | 9/1960 | United Kingdom . |

*Primary Examiner*—Charles G. Freay
*Attorney, Agent, or Firm*—Herbert L. Lerner; Laurence A. Greenberg; Werner H. Stemer

[57] ABSTRACT

A heat-shield component with a cooling-fluid return, a hot-gas wall to be cooled, an inlet duct for conducting a cooling fluid and an outlet duct for returning the cooling fluid. The inlet duct is directed towards the hot-gas wall and widens in a direction of the hot-gas wall. Furthermore, the invention relates to a heat-shield configuration which lines a component directing a hot gas, in particular a combustion chamber of a gas-turbine plant. The heat-shield configuration and has a plurality of the heat-shield components.

17 Claims, 4 Drawing Sheets

HEAT-SHIELD COMPONENT WITH COOLING-FLUID RETURN AND HEAT-SHIELD CONFIGURATION FOR A COMPONENT DIRECTING HOT GAS

CROSS REFERENCE TO RELATED APPLICATION

This application is a continuation of International Application PCT/DE97/02168, filed Sep. 24, 1997, which designated the United States.

The invention relates to a heat-shield component having a hot-gas wall to be cooled as well as to a heat-shield configuration which lines a component directing a hot gas, in particular a combustion chamber of a gas-turbine plant, and has a plurality of heat-shield components.

A heat-shield configuration, in particular for structural parts of gas-turbine plants, is described in European Patent Application EP 0 224 817 B1. The heat-shield configuration serves to protect a supporting structure from a hot fluid, in particular to protect a hot-gas-duct wall in gas-turbine plants. The heat-shield configuration has an inner lining that is made of heat-resistant material and is composed of heat-shield elements in such a way as to cover the surface, which heat-shield elements are anchored to the supporting structure. The heat-shield elements are disposed next to one another while leaving gaps for the through flow of a cooling fluid and are thermally movable. Each of the heat-shield elements has a cap part and a shank part like a mushroom. The cap part is a flat or spatial, polygonal plate body having straight or curved boundary lines. The shank part connects the central region of the plate body to the supporting structure. The cap part preferably has a triangular shape, as a result of which an inner lining of virtually any geometry can be produced by identical cap to parts. The cap parts as well as, if need be, other parts of the heat-shield elements are made of a highly heat-resistant material, in particular a steel. The supporting structure has bores through which the cooling fluid, in particular air, can flow into an intermediate space between the cap part and the supporting structure. The air can flow from there through the gaps, intended for the through flow of the cooling fluid, into a spatial region, for example a combustion chamber of a gas-turbine plant, surrounded by the heat-shield elements. The cooling-fluid flow reduces the ingress of the hot gas into the intermediate space.

A metallic lining for a combustion chamber is described in U.S. Pat. No. 5,216,886. The lining consists of a multiplicity of cubic hollow components (cells) which are disposed next to one another and are fastened to a common metal plate. The common metal plate has an opening allocated in each case to each cubic cell and is intended for the inflow of cooling fluid. The cubic cells are in each case disposed, next to one another while leaving a gap. They contain in each side wall in the vicinity of the common metal plate a respective opening for the outflow of the cooling fluid. The cooling fluid therefore passes-into the gaps between adjacent cubic cells, flows through the gaps and forms a cooling film on a surface of the cells which can be exposed to a hot gas and is directed parallel to the metallic plate. In the wall structure configuration described in U.S. Pat. No. 5,216,886, an open cooling system is defined in which cooling air passes via a wall structure through the cells into the interior of the combustion chamber. The cooling air is therefore lost for further cooling purposes.

Described in Published, Non-Prosecuted German Patent Application DE 35 42 532 A1 is a wall, in particular for gas-turbine plants, which has cooling-fluid ducts. In gas-turbine plants, the wall is preferably disposed between a hot space and a cooling-fluid space. It is assembled from individual wall elements, each of the wall elements being a plate body made of highly heat-resistant material. Each plate body has cooling ducts which are distributed over its base surface, are parallel to one another and communicate at one end with the cooling-fluid space and at the other end with the hot space. The cooling fluid, flowing into the hot space and directed through the cooling-fluid ducts, forms a cooling-fluid film on the surface of the wall element that faces the hot space and/or on the surface of adjacent wall elements which faces the hot space.

SUMMARY OF THE INVENTION

It is accordingly an object of the invention to provide a heat-shield component with a cooling-fluid return and a heat-shield configuration for a component directing a hot gas that overcomes the above-mentioned disadvantages of the prior art devices of this general type, which can be cooled with the cooling fluid as well as a heat-shield configuration having heat-shield components, so that at most a small loss of cooling fluid and/or a small pressure loss occurs during the cooling of the heat-shield component.

With the foregoing and other objects in view there is provided, in accordance with the invention, a heat-shield component, including: a component body having an interior space formed therein and a hot-gas wall to be cooled partially defining the interior space; an inlet duct fluidically communicating with and conducting an inflow of cooling fluid to the interior space, the inlet duct directed towards and widening towards the hot-gas wall; an outlet duct fluidically communicating with the interior space for conducting the cooling fluid from the interior space; and a discharge duct connected to the outlet duct for receiving and discharging the cooling-fluid.

According to the invention, the object directed towards a heat-shield component is achieved by a heat-shield component which has an interior space, a hot-gas wall to be cooled and adjoining the interior space, an inlet duct and an outlet duct for conducting the cooling fluid. In the heat-shield component the inlet duct is directed towards the hot-gas wall and widens in the direction of the hot-gas wall. The outlet duct for a return of the cooling fluid can be connected to a discharge duct. The inlet duct, the outlet duct and the closed hot-gas wall effect a complete return of the cooling fluid, so that no loss of cooling fluid at all occurs due to the cooling of the heat-shield component.

The inlet duct is preferably covered by a cover wall, e.g. an impact-cooling plate, which is adjacent to the hot-gas wall and has passages for directing the flow of the cooling fluid. Widening of the inlet duct, which widening is closed off by the cover wall provided with passages, brings about impact cooling of the hot-gas wall over its entire inner surface.

The heat-shield component is preferably made of a heat-resistant material including a metal or a metal alloy which in particular is cast in a highly precise manner (high-quality casting).

An improvement in the cooling can be achieved by the hot-gas wall having cooling ribs on its inner surface. The cooling fluid which has reached the hot-gas wall through the cover plate flows along the cooling ribs. The cooling ribs may be connected to the cover plate.

Air from a compressor of a gas-turbine plant can preferably be fed to the inlet duct. The air directed through the heat-shield component preferably passes via the outlet duct into a combustion chamber, into one or more burners and/or a compressor of the gas-turbine plant.

During the return of the cooling air from the interior space of the heat-shield component, mixing of the hot gas and the cooling fluid, in particular cooling air, does not occur, so that, if need be, a low hot-gas temperature can be set in the gas-turbine plant. This is associated with a reduction in the formation of nitrogen oxide. Due to the closed cooling-air return, flow around the edges of a heat-shield component likewise does not occur, so that a harmonic temperature distribution with low thermal stresses can be set in the material (i.e. metal) of the heat-shield component. The supply of cooling air to the heat-shield component and the return of the heated cooling air to a burner of the gas-turbine plant are preferably effected via axially parallel supply ducts. The ducts can be widened as desired in the radial direction and their cross-sections can be adapted to the requisite cooling-air quantity. All heat-shield components therefore have essentially identical cooling-air inlet conditions. The flow path to the heat-shield components or of the heated cooling air to the burner is only affected by relatively slight pressure losses on account of its shortness. The supply to the heat-shield components disposed on an outer side of a rotationally symmetrical component directing hot gas, in particular a combustion chamber of a gas-turbine plant, is preferably effected via the guide blades of the first guide-blade row of the gas turbine. If the quantity of cooling air which can be directed through the guide blades is insufficient for adequate cooling of the heat-shield components, it is of course possible to direct supply ducts past the outer side of the component directing the hot gas, in particular the combustion chamber.

The return of the heated cooling air is preferably effected via separate discharge ducts that lead directly to a burner of the gas-turbine plant. It is likewise possible to lead the outlet duct of the heat-shield components directly into a main duct in which the compressor air is fed to the burner. In this way, the heat absorbed in the heat-shield components can be fed again to the gas-turbine process in an especially favorable manner.

The outer wall of the heat-shield component, which outer wall extends from the hot-gas wall in the direction of the supporting structure, may be corrugated, at least zonally, in the vicinity of the hot-gas wall. In this way, the transition of the outer wall from the region acted upon by the hot gas up to a cold region adjacent to the supporting structure can be configured to reduce stress. The inlet duct is preferably surrounded by the outlet duct in the interior of the heat-shield component. It may also widen in a funnel shape towards the cover plate.

For fastening to a supporting structure of the component directing the hot gas, in particular the combustion chamber of the gas-turbine plant, the heat-shield component preferably has a fastening part which surrounds the inlet duct and the outlet duct. The fastening part preferably has a base region that runs parallel to the supporting structure and is fastened there, for example, by screws.

The heat-shield component preferably has an outer wall that adjoins the hot-gas wall and has a retaining step at least zonally. A fastening component can be disposed, for example with a head part, on the retaining step, in which case the fastening component can be connected to the supporting structure of the combustion chamber. The fastening component thus retains the heat-shield component on the supporting structure and enables the heat-shield component to expand freely on account of the thermal loading. The fastening component may be a cooled screw that is cast in a highly precise manner.

The hot-gas wall preferably has a wall thickness of less than 10 mm. The wall thickness is preferably within a range of 3 to 5 mm, as a result of which high a resistance of the heat-shield components to load variations can be achieved on account of a small temperature difference between the inner and the outer surface.

The object directed towards a heat-shield configuration for lining a component directing a hot gas, in particular a combustion chamber of a gas-turbine plant, is achieved by a heat-shield configuration which has a plurality of heat-shield components with a cooling-fluid return. The heat-shield component has in each case a hot-gas wall to be cooled, which at its outer surface faces a hot gas that can be directed through the combustion chamber. The heat-shield component enables the cooling air to be directed in a closed circuit without a cooling-air loss, in the course of which the cooling air can be fed through an inlet duct, which widens towards the hot-gas wall, and can be discharged via an outlet duct. Cooling fluid is fed to the inlet duct via a feed duct that is connected, for example, to the compressor of a gas-turbine plant. The heated cooling fluid flowing out of the outlet duct, is fed to a discharge duct and passes from there into the burner of a gas-turbine plant. At least one feed duct is preferably led through a guide blade of the gas-turbine plant.

Each heat-shield component has a hot-gas wall, the outer surface of which faces the flow region configured for directing the hot gas and to which the cooling fluid can be fed via an inlet duct according to the principle of impact cooling. The cooling fluid rebounding from the hot-gas wall can be directed out of the hot-gas wall again via an outlet duct. The cooling fluid, in particular air, which has flowed into the heat-shield component therefore passes completely out of the latter again and is thus available for feeding into the thermodynamic cycle process in the gas-turbine plant.

The heat-shield component preferably has a retaining step on an outer wall, and the fastening component bears with a head part against the retaining step. Via a shank part connected to the head part, the fastening component is fastened to a supporting structure, as a result of which the heat-shield component is disposed on the supporting structure in a thermally movable manner. The shank part is preferably fastened elastically to the supporting structure, for example via a spring configuration, so that there is a thermally movable and nonetheless firm connection between the fastening component and the heat-shield component. The fastening component preferably has a cooling duct through which cooling fluid can flow and can therefore likewise be adequately cooled. The cooling duct may be opened into the interior space of the component directing hot gas, so that small quantities of cooling fluid flow into this interior space. Even in this case, the loss of cooling fluid is extremely small.

Other features which are considered as characteristic for the invention are set forth in the appended claims.

Although the invention is illustrated and described herein as embodied in a heat-shield component with a cooling-fluid return and a heat-shield configuration for a component directing a hot gas, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
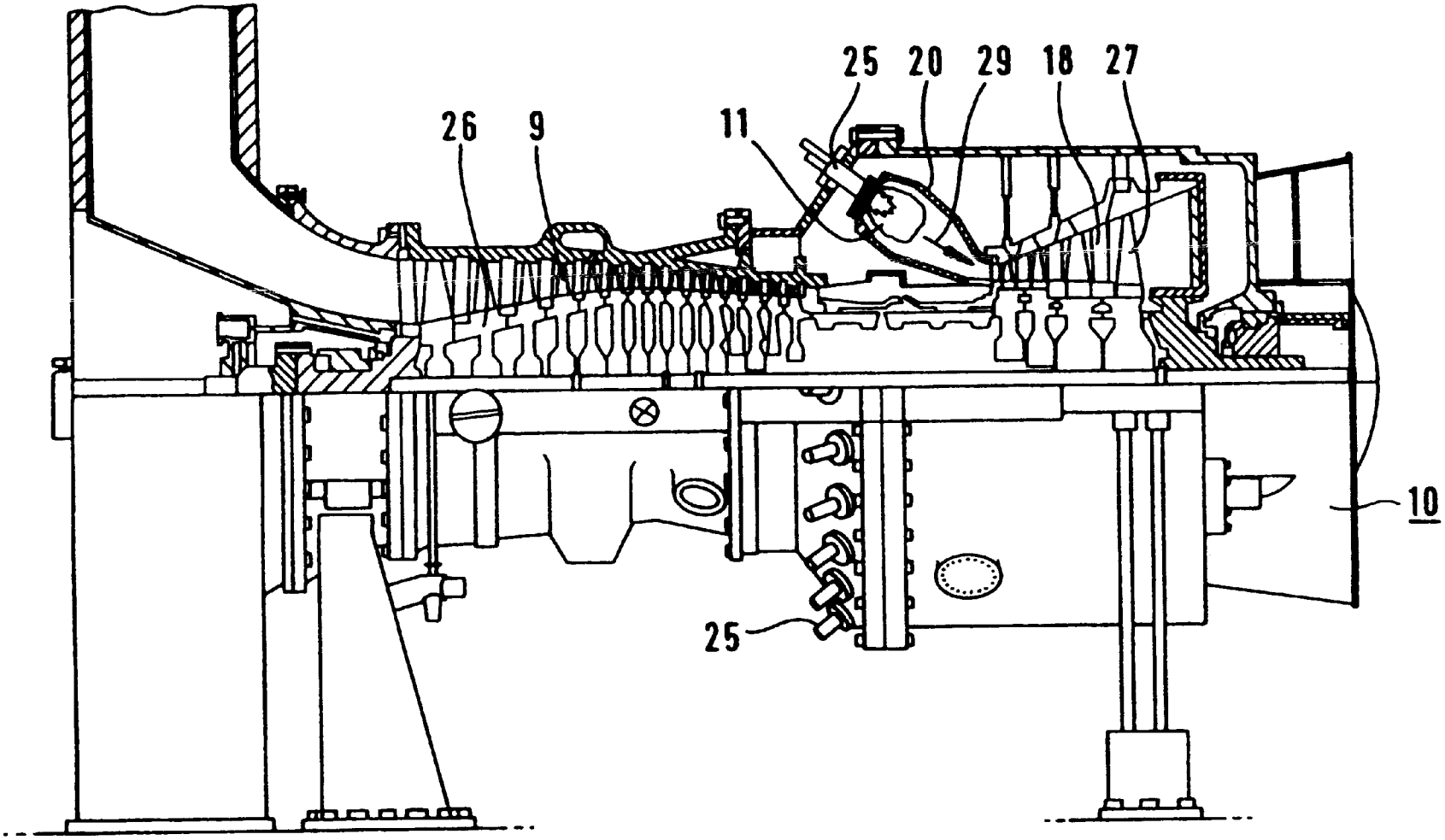
FIG. 1 is a diagrammatic, fragmentary, partial longitudinal sectional view of a gas-turbine plant having an annular combustion chamber.

In all the figures of the drawing, sub-features and integral parts that correspond to one another bear the same reference symbol in each case. Referring now to the figures of the drawing in detail and first, particularly, to FIG. 1 thereof, there is shown a gas-turbine plant 10 which is shown partly cut open longitudinally. The gas-turbine plant 10 has a shaft 26 and, connected one behind the other in a axial direction, a compressor 9, an annular combustion chamber 11 and a blading including guide blades 18 and moving blades 27. Combustion air is compressed and heated in the compressor 9, which combustion air is partly fed as a cooling fluid 4 (see FIGS. 2, 3, 4) to a heat-shield configuration 20. The compressed air is fed to a plurality of burners 25 that are disposed in a circle around the annular combustion chamber 11. A fuel burned with the compressor air in the burners 25 forms a hot gas 29 in the combustion chamber 11. The hot gas flows out of the combustion chamber 11 and into the blading 18, 27 of the gas-turbine plant 10 and thus causes the shaft 26 to rotate.

Figure 2:
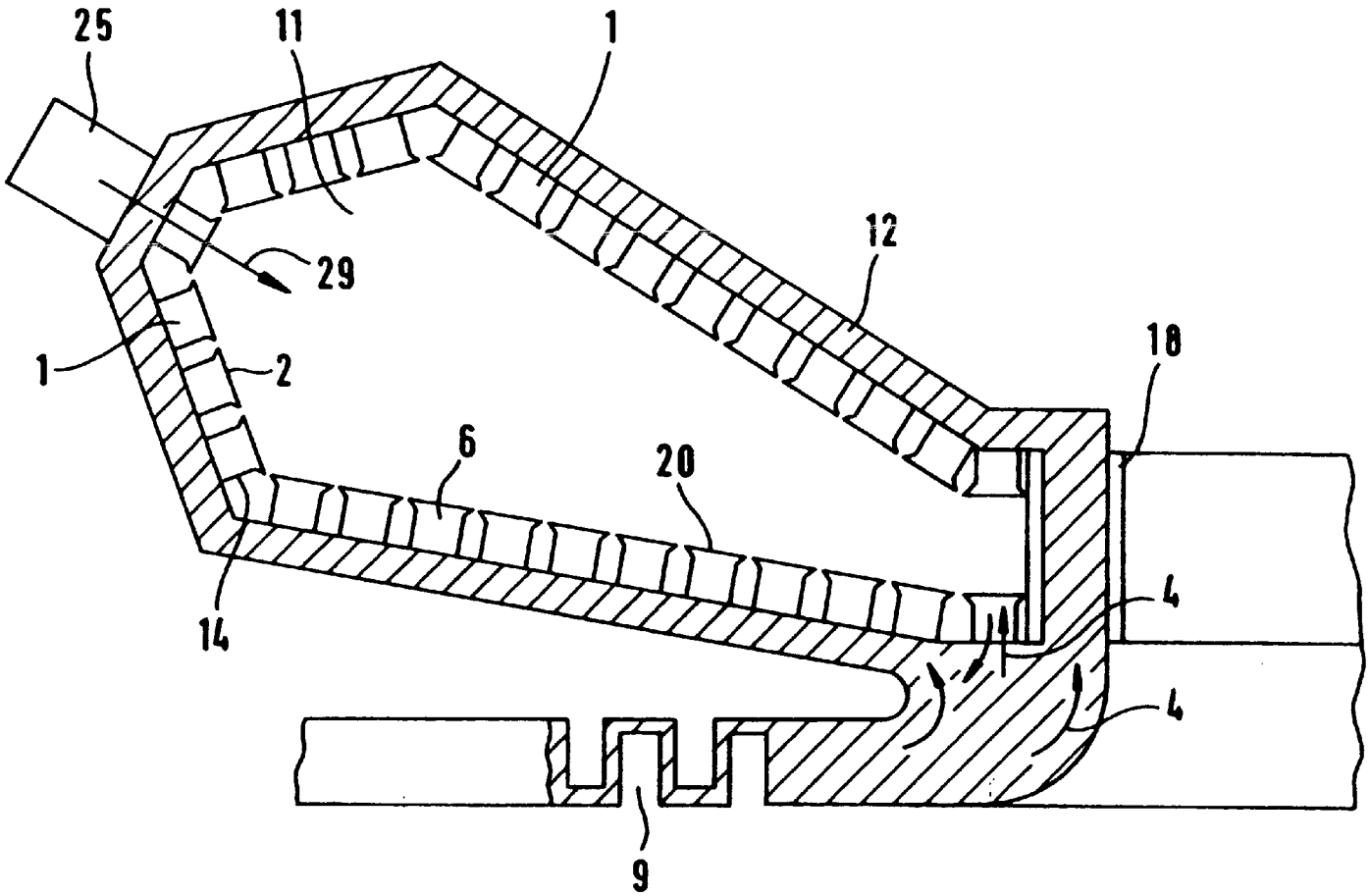
FIG. 2 is a fragmentary, longitudinal sectional view of the annular combustion chamber.

The combustion chamber 11, shown on an enlarged scale in a longitudinal section in FIG. 2, has the heat-shield configuration 20 that is composed of a plurality of heat-shield components 1. The compressor air compressed in the compressor 9 is directed in a feed duct 12 along the combustion chamber 11 to each heat-shield component 1. Some of the compressor air is directed as cooling air 4 into each heat-shield component 1. A partial flow of the compressor air is directed through the guide blades 18 of a first guide-blade row of the gas-turbine plant 10. The compressor air as well as the cooling air 4 heated in the heat-shield components 1 are fed to the burner 25 in which fuel is burned. The combustion of the fuel in the burner 25 produces the hot gas 29 which flows through the combustion chamber 11 to the guide blade 18. The hot gas 29 acts upon each heat-shield component 1 at a hot-gas wall 2. The interior 6 of each heat-shield component 1 is defined by the hot-gas wall 2 and an adjoining outer wall 14 directed towards the feed duct 12.

Figure 3:
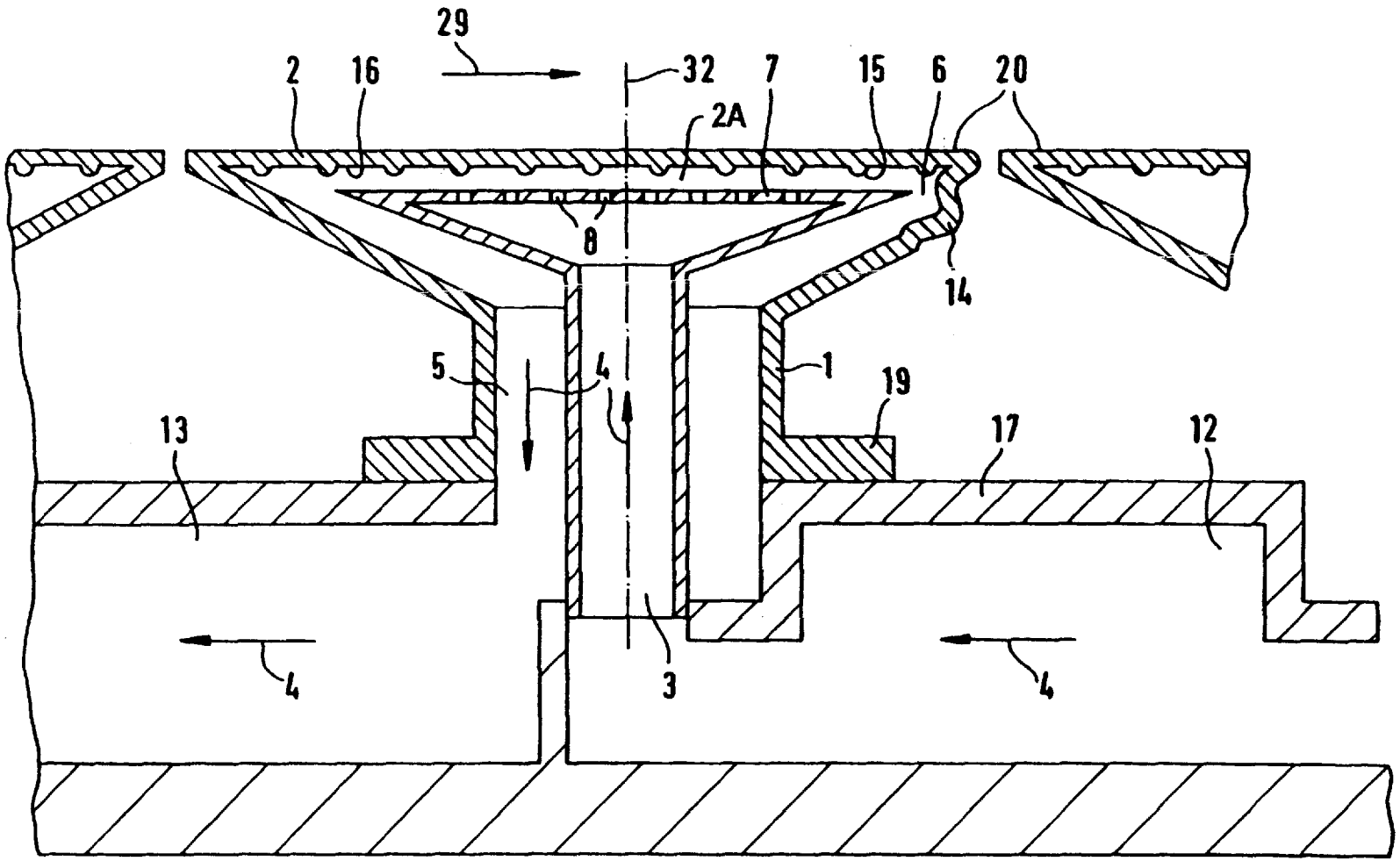
FIGS. 3 and 4 are fragmentary, longitudinal sectional views through a heat-shield configuration of the annular combustion chamber.

A cutaway portion through the combustion chamber 11 in the region of a supporting structure 17 is shown in longitudinal section in FIG. 3. The heat-shield configuration 20 having the plurality of heat-shield components 1 is disposed on the supporting structure 17. Each heat-shield component 1 is directed along a main axis 32 which is disposed essentially perpendicularly to the supporting structure 17. The heat-shield component 1 has the hot-gas wall 2 which runs essentially parallel to the supporting structure 17 and is exposed to the hot gas 29 and adjoins an interior space 2A. An inlet duct 3 directed along the main axis 32 and intended for the cooling fluid 4 widens out in the direction of the hot-gas wall 2 into the interior space 2A. It is closed off by a cover wall 7 that has passages 8 for the through flow of the cooling fluid 4. The cover wall 7 is directed essentially parallel to the hot-gas wall 2 and reaches essentially over its entire extent. The cooling fluid 4 flowing through the passages 8 strikes an inner surface 16 and brings about impact cooling there. On the inner surface 16, the hot-gas-wall 2 has cooling ribs 15 that produce an increase in the heat transfer from the hot-gas wall 2 to the cooling fluid 4. The heated cooling fluid 4 passes from the inner surface 16 out of the interior space 2A of the heat-shield component 1 through an outlet duct 5 running essentially parallel to the main axis 32. The cooling fluid 4 used to cool the heat-shield component 1 therefore passes completely out of the heat-shield component 1 again. Adjoining the outlet duct 5 is a discharge duct 13, which, for example, may be made as a tube and is welded to the supporting structure 17. The discharge duct 13 preferably leads to the burner 25 of the gas-turbine plant 10. The feed duct 12 and the discharge duct 13 are directed parallel to the shaft 26.

An outer wall 14 is configured to be corrugated, at least zonally, in the vicinity of the hot-gas wall 2, as a result of which a reduction in stress is achieved between regions heated by the hot gas 29 and the cooled regions of the heat-shield component 1. The outer wall 14 merges into a fastening part 19, which is directed at least partly parallel to the supporting structure 17 and is fastened in the region, directed in parallel, to the supporting structure 17, for example via non-illustrated screws. The feed duct 12 narrows at the transition to the inlet duct 3, and accordingly the discharge duct 13 widens at the transition from the outlet duct 5.

Figure 4:
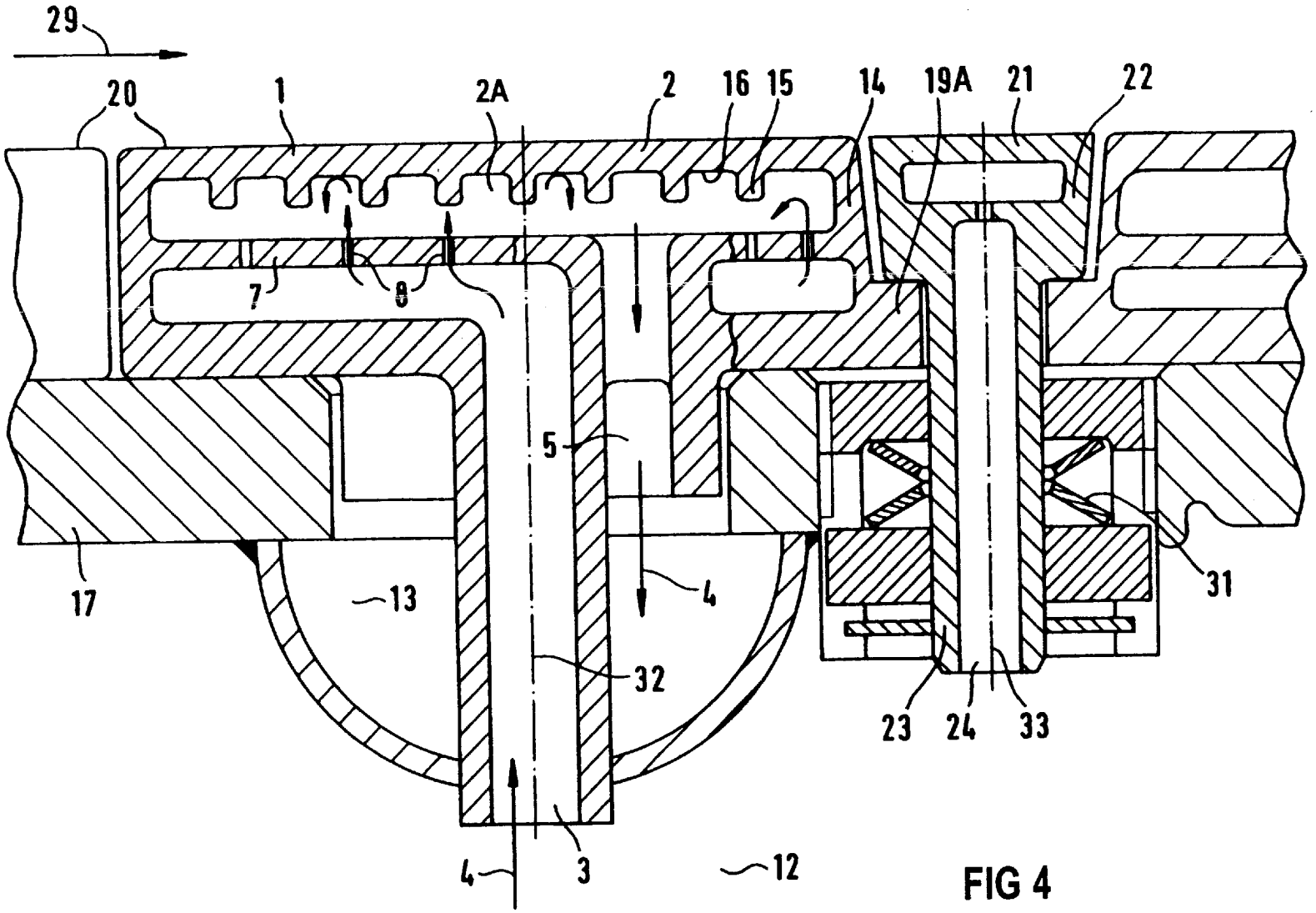

A cutaway portion through the combustion chamber 11 in a region of the supporting structure 17 is shown in longitudinal section in FIG. 4. The heat-shield configuration 20, having the plurality of heat-shield components 1, as well as fastening components 21, which fasten the heat-shield components 1 and are in the form of cooled screws, are disposed on the supporting structure 17. The heat-shield component 1 is directed along the main axis 32 which is essentially perpendicular to the supporting structure 17. The heat-shield component 1 has the hot-gas wall 2 which runs essentially parallel to the supporting structure 17 and is exposed to the hot gas 29 and defines, at least zonally, an interior space 2A. The inlet duct 3 directed along the main axis 32 and intended for the cooling fluid 4 widens out in the interior space 2A in the direction of the hot-gas wall 2. The interior space 2A is closed off by the cover wall 7 that has the passages 8 for the through flow of the cooling fluid 4. The cover wall 7 is directed essentially parallel to the hot-gas wall 2 and reaches essentially over its entire extent. The cooling fluid 4 flowing through the passages 8 strikes the inner surface 16 of the hot-gas wall 2 and brings about impact cooling there. On the inner surface 16, the hot-gas wall 2 has the cooling ribs 15, or similar elements improving the heat transfer, which produce an increase in the heat transfer from the hot-gas wall 2 to the cooling fluid 4. The heated cooling fluid 4 passes from the inner surface 16 out of the interior space 2A of the heat-shield component 1 through the outlet duct 5 running essentially parallel to the main axis 32. The cooling fluid 4 used to cool the heat-shield component 1 therefore passes completely, i.e. without loss, out of the heat-shield component 1 again. The outlet duct 5 is preferably of a concentric configuration. The hot-gas wall 2 has a wall thickness of between 3 mm and 5 mm, so that, on account of small temperature differences in it, the heat-shield configuration 20 composed of the heat-shield components 1 has a high resistance to load variations. On account of the simple fastening, the heat-shield components 1 can also be assembled and dismantled individually from the combustion chamber 11. They are likewise simple to coat on account of their simple geometry. Adjoining the outlet duct 5 is the discharge duct 13, which, for example, may be made as a tube and is welded to the supporting structure 17. The discharge duct 13 preferably leads to a burner 25 of the gas-turbine plant 10. The discharge duct 13 may also be a cast component of the supporting structure 17.

For fastening to the supporting structure 17, the heat-shield component 1 has a retaining step 19A on the outer wall 14 running essentially parallel to the main axis 32. The fastening, component 21 directed along a main axis 33 bears with a head part 22 against the retaining step 19A. Adjoining the head part 22 is a shank part 23, which passes through the supporting structure 17 and is elastically fastened to the latter with disc springs 31. The fastening component 21, which is preferably produced as a high-quality casting, has a cooling duct 24 which extends along the main axis 33 and leads into the combustion chamber 11. The cooling duct 24 is fed with the cooling fluid 4 from a feed duct 12 running along the supporting structure 17. The cooling fluid 4 flowing through the fastening component 21 cools the latter and therefore provides adequate protection against the hot gas 29.

The invention is distinguished by a heat-shield component that is preferably formed as a precision cast part (high-quality casting) and ensures complete return of cooling fluid. In the interior of the heat-shield component, cooling fluid strikes the entire inner surface of the hot-gas wall exposed to the hot gas, as a result of which the hot-gas wall is effectively cooled. The heated cooling fluid, in particular compressor air, is directed out of the heat-shield component through an outlet duct and is preferably fed to a burner of the gas-turbine plant. Depending on the construction and fastening of the heat-shield element, cooling fluid branched off from the compressor air is completely returned into the main flow of the compressor air. This leads to a distinct increase in the efficiency of the gas-turbine plant.

We claim:

1. A heat-shield component, comprising:

a component body having an interior space formed therein and a hot-gas wall to be cooled partially defining said interior space;

an inlet duct fluidically communicating with and conducting an inflow of cooling fluid to said interior space, said inlet duct directed towards and widening towards said hot-gas wall;

an outlet duct fluidically communicating with said interior space for conducting the cooling fluid from said interior space; and a discharge duct connected to said outlet duct for receiving and discharging the cooling-fluid.

2. The heat-shield component according to claim 1, wherein said outlet duct substantially surrounds said inlet duct.

3. The heat-shield component according to claim 1, wherein said inlet duct has an end and a cover wall covering said end, said cover wall disposed adjacent said hot-gas wall and has passages formed therein for directing a flow of the cooling fluid.

4. The heat-shield component according to claim 1, wherein said component body, said inlet duct, said outlet duct and said discharge duct are formed from a material selected from the group consisting of a metal, a metal alloy, a cast metal and a cast metal alloy.

5. The heat-shield component according to claim 1, wherein said inlet duct is fed air as the cooling fluid from a compressor, and the air is fed via said outlet duct to at least one of a combustion chamber and the compressor of a gas-turbine plant.

6. The heat-shield component according to claim 1, wherein said component body has a corrugated outer wall adjoining said hot-gas wall.

7. The heat-shield component according to claim 1, including a fastening part surrounding said inlet duct and said outlet duct for fastening to a supporting structure.

8. The heat-shield component according to claim 1, wherein said hot-gas wall has an inner surface and cooling-ribs disposed on said inner surface.

9. The heat-shield component according to claim 1, wherein said inlet duct widens into a funnel shape.

10. The heat-shield component according to claim 1, wherein said component body has an outer wall with a retaining step and adjoins said hot-gas wall.

11. The heat-shield component according to claim 1, wherein said hot-gas wall has, at least regionally, a wall thickness of less than 10 mm.

12. The heat-shield component according to claim 1, wherein said hot-gas wall has, at least regionally, a wall thickness of between 3 mm and 5 mm.

13. A heat-shield configuration for lining a combustion chamber directing a hot gas of a gas-turbine plant, comprising:

a plurality of heat-shield components having a cooling-fluid return, each of said heat-shield components having a hot-gas wall to be cooled for forming a lining, an inlet duct for conducting a cooling fluid, and an outlet duct for conducting the cooling fluid, said inlet duct directed towards and widening in a direction of said hot-gas wall;

a feed duct connected to said inlet duct for supplying the cooling fluid; and a discharge duct connected to said outlet duct for discharging the cooling fluid.

14. The heat-shield configuration according to claim 13, wherein said feed duct is led through a guide blade of a gas-turbine plant.

15. The heat-shield configuration according to claim 13, wherein at least one of said feed duct and said discharge duct is directed essentially perpendicularly to a shaft of a gas-turbine plant.

16. The heat-shield configuration according to claim 13, wherein each of said heat-shield components has an outer wall with a retaining step, and including fastening components each having a head part and a shank part provided for fastening to a supporting structure, said shank part of each of said fastening components are fastened to the supporting structure, and said head part of each of said fastening components bearing on said retaining step so as to retain each of said heat-shield components.

17. The heat-shield configuration according to claim 16, wherein each of said fastening components has a cooling passage formed therein for receiving the cooling fluid to cool each of said fastening components.

* * * * *